US011594109B2

(12) United States Patent
Grant et al.

(10) Patent No.: US 11,594,109 B2
(45) Date of Patent: Feb. 28, 2023

(54) SECURE SAFE APPARATUS AND SYSTEM

(71) Applicant: NCR Corporation, Atlanta, GA (US)

(72) Inventors: Andrew Robert Grant, Dunblane (GB); Ian Mcfarlane Denny, Perth (GB)

(73) Assignee: NCR Corporation, Atlanta, GA (US)

( * ) Notice: Subject to any disclaimer, the term of this patent is extended or adjusted under 35 U.S.C. 154(b) by 88 days.

(21) Appl. No.: 17/161,000

(22) Filed: Jan. 28, 2021

(65) Prior Publication Data

US 2022/0237992 A1 Jul. 28, 2022

(51) Int. Cl.

| | |
|---|---|
| ***G07F 19/00*** | (2006.01) |
| ***E01F 9/658*** | (2016.01) |
| ***E01F 13/12*** | (2006.01) |

(52) U.S. Cl.

CPC ..... *G07F 19/205* (2013.01); *E01F 9/658* (2016.02); *E01F 13/12* (2013.01)

(58) Field of Classification Search

CPC ..... G07F 19/205

USPC ..... 235/379; 109/50

See application file for complete search history.

(56) References Cited

U.S. PATENT DOCUMENTS

2013/0000227 A1* 1/2013 Hannon ..... G07F 19/205 52/173.1

2019/0203872 A1* 7/2019 Cifuentes Lopez .. G07F 19/205

* cited by examiner

*Primary Examiner* — Suezu Ellis

(74) *Attorney, Agent, or Firm* — Schwegman, Lundberg & Woessner

(57) ABSTRACT

In an embodiment, a secure safe apparatus is provided. The apparatus comprises a base and a bollard. The bollard comprises a first portion and a second portion manufactured as a single vertical member. The first portion is of sufficient length to extend below a bottom surface of the base into ground at a site where the secure safe apparatus is set. The second portion is of sufficient length to extend through a thickness of the base and above a top surface of the base. The second portion is adapted to be inserted through an aperture in a floor of a safe and affixed to an interior beam manufactured within an inside of the safe to affix the second portion to the beam.

20 Claims, 12 Drawing Sheets

SECURE SAFE APPARATUS AND SYSTEM

BACKGROUND

Many Automated Teller Machines (ATMs) are located outdoors for ease of customer access; some outdoor ATMs are also drive thru accessible. A drive-thru ATM permits a customer to operate the ATMs while remaining in his/her vehicle.

Outdoor ATMs are convenient, but they have unique security concerns which indoor ATMs do not. For example, a determined thief may attempt to steal the whole ATM, take it to a remote location, and blast the safe open. Thieves have become increasingly brazen in their attempts to access the ATMs' safes. Some thieves have even wrapped chains around the ATMs, affixed the other ends of the chains to their vehicles, and dragged the ATMs off.

Most drive-thru ATMs are secured to a manufactured island that is bolted to a concrete slab. Some are also surrounded by two to four concrete posts designed to prevent the ATMs from being rammed by vehicles. An ATM's safe is located at the bottom of the ATM and is manufactured with a combination of steel and concrete; the floor of the ATM's safe is bolted to the island and sometimes bolted to both the island the concrete slab, which the island is also bolted to.

Yet, this structural arrangement is still not sufficient enough to withstand the force that most vehicles can generate when a safe is ripped from the island using heavy chains or rammed at a substantial speed. In fact, a large consumer truck may generate enough force to pull the concrete slab from the ground when the slab is not of sufficient thickness, size, and set at a sufficient depth below the ground. Furthermore, the safe bolts are easily ripped from the island-slab combination even when the slab is of sufficient thickness and size.

SUMMARY

In various embodiments, a secure safe apparatus and system are provided.

According to an aspect, a secure safe apparatus is provided. The apparatus comprises a base and a bollard. The bollard comprises a first portion and a second portion manufactured as a single vertical member. The first portion is of sufficient length to extend below a bottom surface of the base into ground at a site where the secure safe apparatus is set. The second portion is of sufficient length to extend through a thickness of the base and above a top surface of the base. The second portion is adapted to be inserted through an aperture in a floor of a safe and affixed to an interior beam manufactured within an inside of the safe to affix the second portion to the beam.

DETAILED DESCRIPTION

Figure 1:
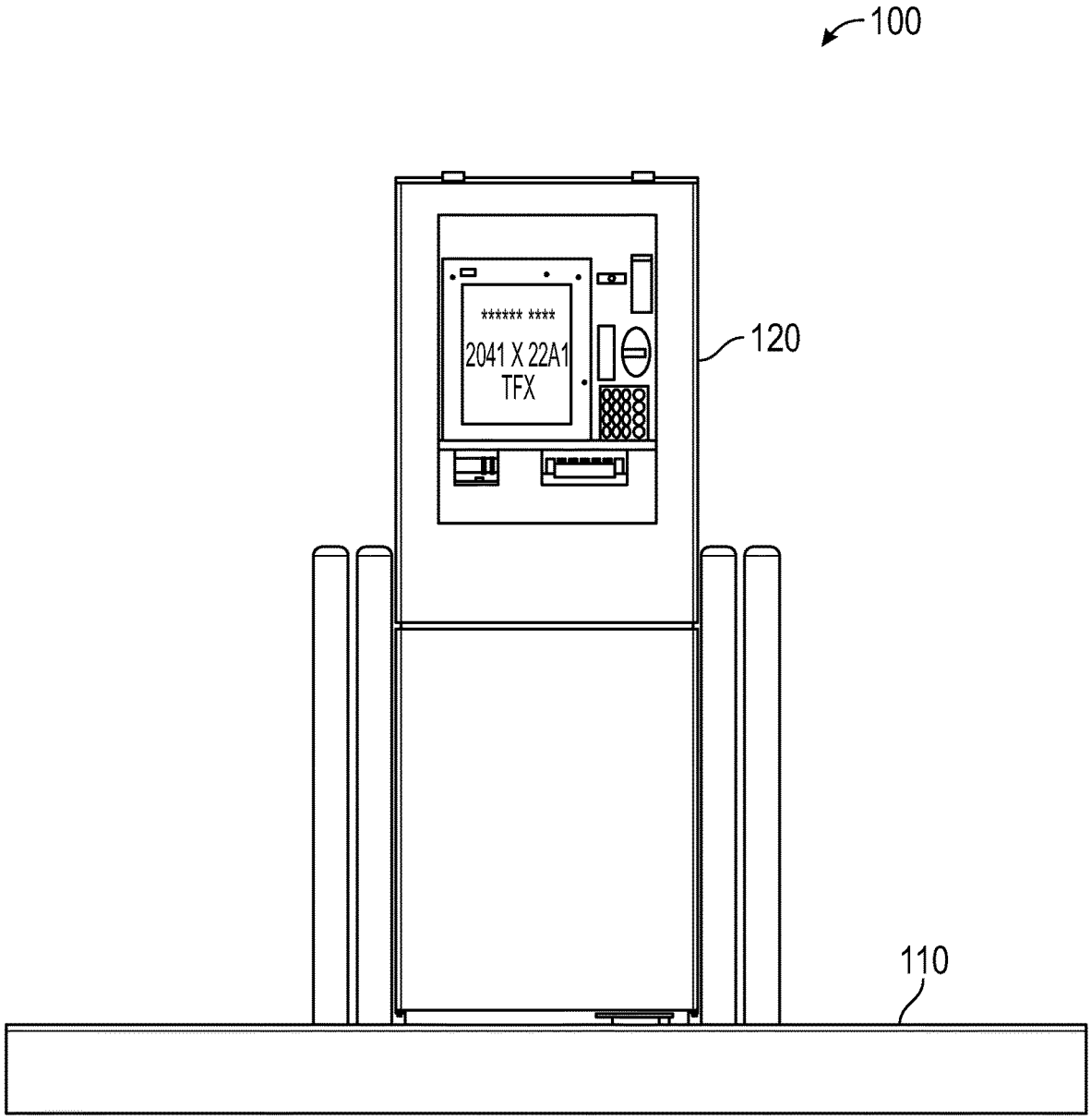
FIG. 1 is a diagram depicting a secure safe system, according to an example embodiment.

FIG. 1 is a diagram depicting a secure safe system 100, according to an example embodiment. It is to be noted that the system 100 is shown with only those components relevant to understanding what has been added and modified for purposes of providing a secure force-resistant system 100.

As will be described more completely herein and below, system 100 provides a force-resistant safe moored to the ground and apparatus. Significant force is required to rip the safe from the ground and apparatus. Conventional vehicles are incapable of generating enough force to pull the safe from system 100, such that trying to drag the safe off its moorings or ramming the safe would require commercial grade earth moving equipment. Any thief attempting to use such equipment required to rip the safe from system 100 would be conspicuous. As a result, system 100 eliminates concerns about safe theft making such theft impractical.

System 100 comprises a secure safe apparatus 110 and an ATM 120. The ATM 120 is set and affixed to a secure safe apparatus 110 in the manners discussed herein and below. ATM 120 comprises a safe 125 (shown more clearly in FIGS. 4-11, discussed below).

Secure safe apparatus 110 may also be referred to as "island 110."

Figure 2:
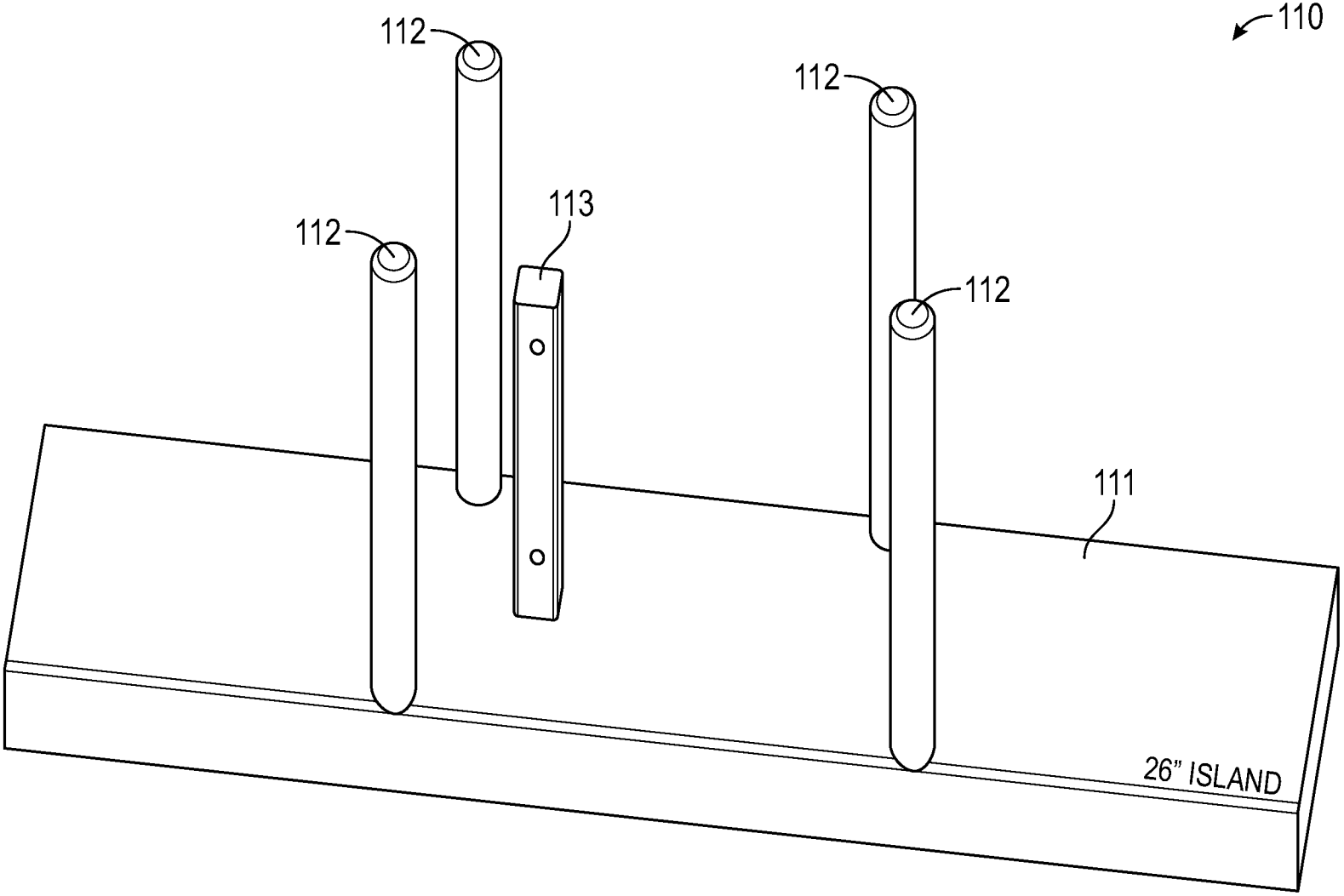
FIG. 2 is a diagram depicting a secure safe apparatus, according to an example embodiment.

FIG. 2 depicts island 110, according to an example embodiment.

Island 110 comprises a base 111, vehicle deterrent posts 112, and a novel bollard 113. Bollard 113 is surrounded by vehicle deterrent posts 112 and oriented to be closer to one set of posts 112 (left set of two posts 112 in FIG. 2). The location of bollard 113 within island 110 is manufactured to coincide and align with a brace 128 (shown and discussed in FIGS. 7, 8, and 11 below) of the ATM's safe 125 (shown and discussed in FIGS. 4-6 and 8-11 below).

Island 100 may be manufactured with a recess in base 111 at a location within base 111 that corresponds to bollard 113 in FIG. 2. Bollard 113 may comprise a separate component of island 100 that is affixed to island 100 when island 100 is set at a site.

Moreover, bollard 113 maybe bolted to sides of a recess in base 111 before concrete is poured into recess and cured.

Bollard 113 is comprised of a combination of concrete and a rebar mesh (metal/steel) having a thickness of at least 100 $mm^2$ and a length of at least 730 mm. Bollard 113 comprises a vertical-squared member manufactured as a combination of concrete and rebar.

Island 100 is set in ground on top of a concrete slab or partially cured within the concrete slab at the desired site.

Figure 3:
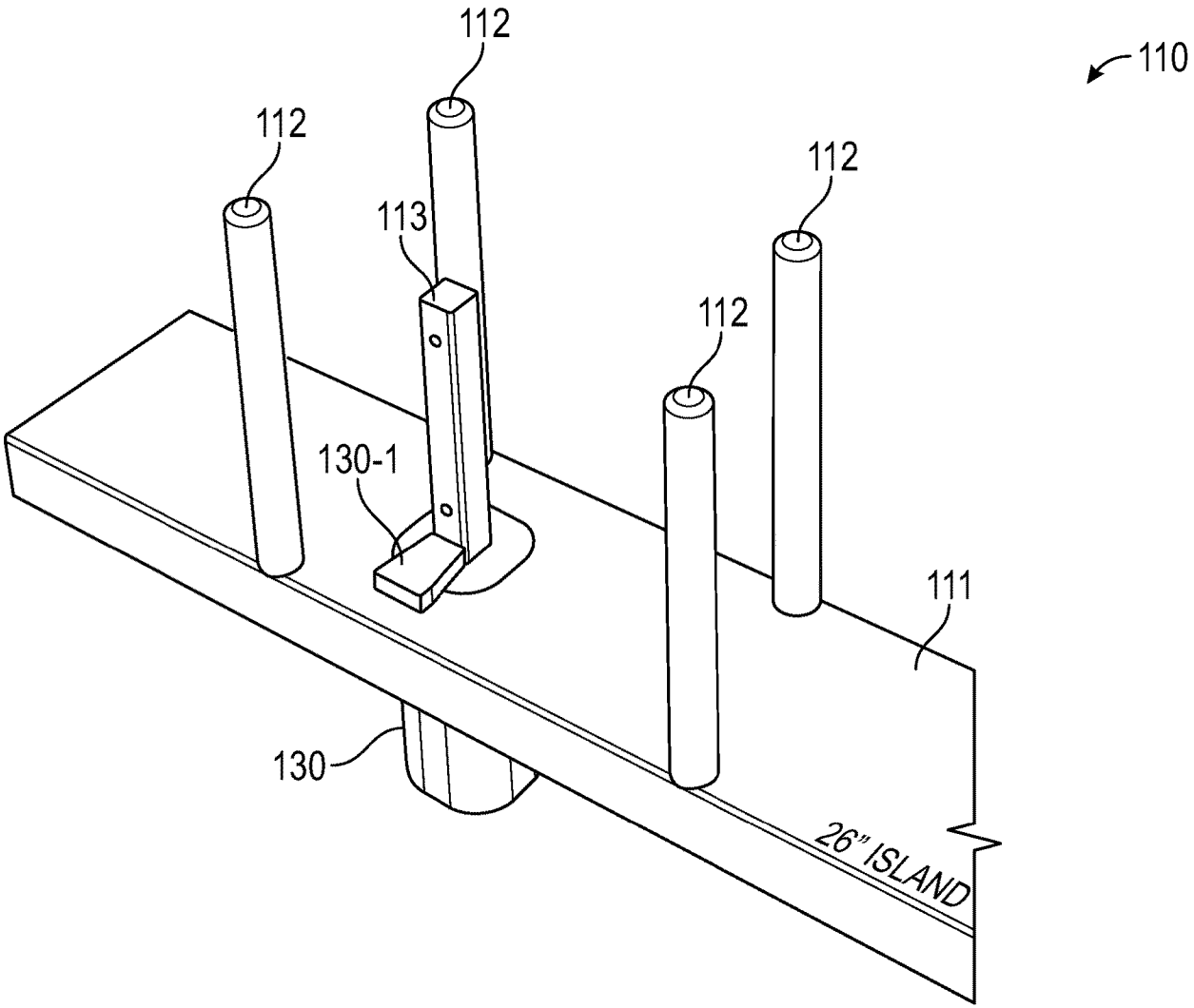
FIG. 3 is a diagram depicting the secure safe apparatus set in concrete, according to an example embodiment.

FIG. 3 depicts concrete cured around bollard 113 creating a column of cured concrete 130 that extends below a bottom surface of island and into a hole in the ground for a distance of at least 150 mm and surrounded within the ground by cured concrete. The concrete 130 is poured within the island's recess with bollard 113 centered therein, such that bollard 113 becomes a permanent fixture of island 110.

Once island 100 is set with bollard 113 at a desired site, bollard 113 comprises a first portion (that extends through the base 111 and into the ground below the island 100 for at least 150 mm) and a second portion that vertically extends upward from a top surface of base 111 for a distance approximately equal to the difference between 730 mm (length of bollard 113) and a sum of 150 mm (depth below a bottom surface of bollard 113) and a manufactured thickness of base 111. A vertical height of the second portion comports with and is slightly less than a height of the inside of the ATM safe 125 being affixed to bollard 113 at a desired site.

Figure 4:
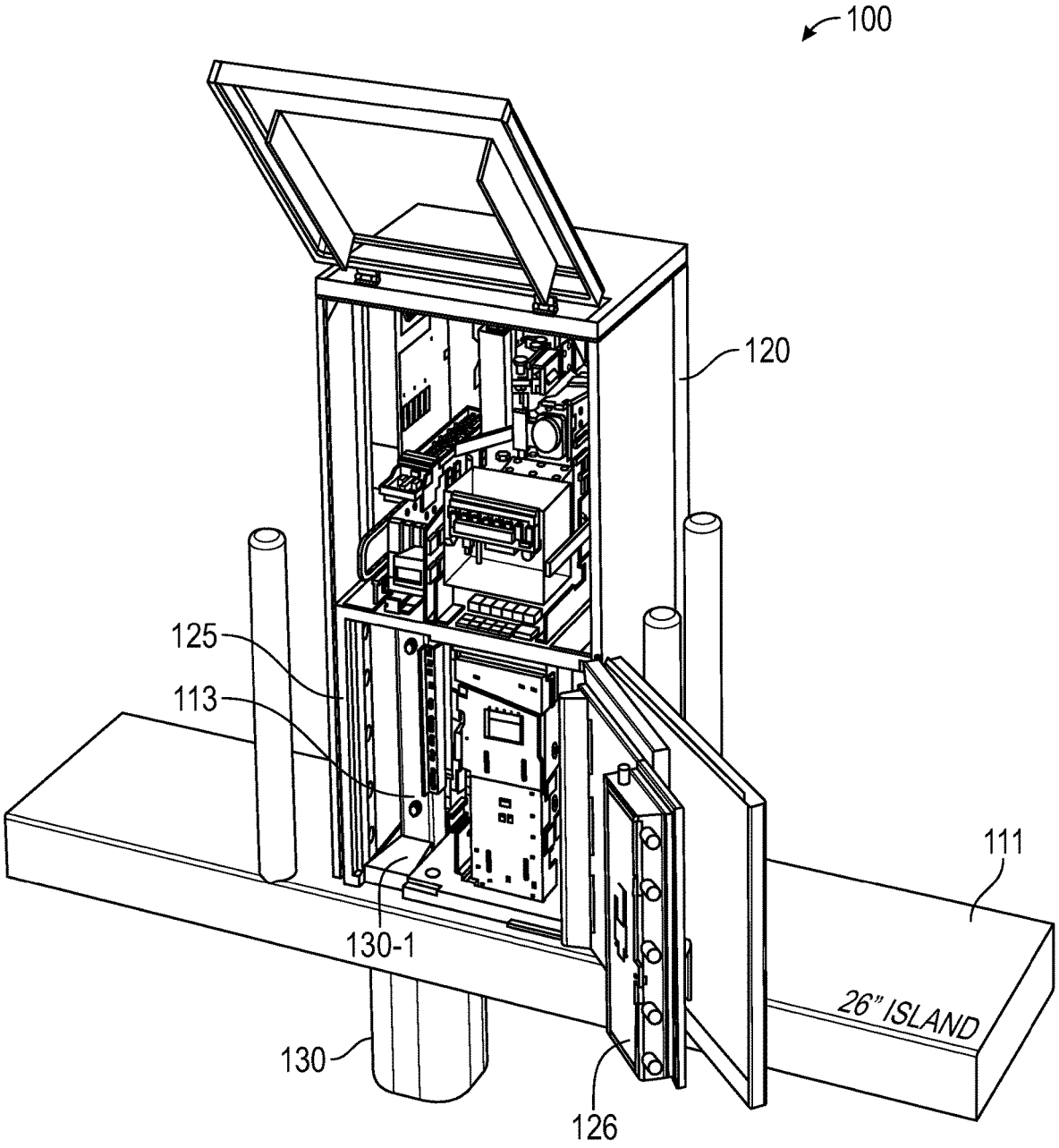
FIG. 4 is a diagram depicting a front view of the secure safe system with a safe door of a safe in an open position, according to an example embodiment.

FIG. 4 depicts system 100 with an ATM 120 having safe 125 bolted to bollard 113 with the first portion of bollard 113 surrounded by cured concrete 130 that extends into the ground below a bottom surface of based 111 of island 110. FIG. 4 also shows ATM 120 with its safe door 126 in an opened position such that an inside of the safe 125 is visible. Second portion of bollard 113 extends vertically upward through the inside of safe 125 for substantially the entire height of an inside area of safe 125.

Also, visible in FIG. 4 is concrete wedge 130-1 poured and cured on a first portion of an inside floor of safe 125. The wedge 130-1 extends from a front bottom surface of the second portion of bollard 113 in a direction of the safe door 126 (towards a front of ATM 120 and a front of island 110). This wedge 130-1 provides added structural support to the second portion of bollard 113.

Wedge 130-1 may be cured at the site when concrete column 130 is cured and the safe 125 is affixed to bollard 113, such that wedge 130-1 and concrete column 130 are one solid cured piece of concrete with or without rebar reinforcement.

Optionally, a small depth within island base 111 and a depth of at least a thickness of the safe's floor is left around the second portion of bollard 113 before the safe 125 is placed at the desired site and this small depth, thickness of safe's floor, and wedge 130-1 are filled with concrete poured and cured after the safe 125 is aligned at the desired site.

Figure 5:
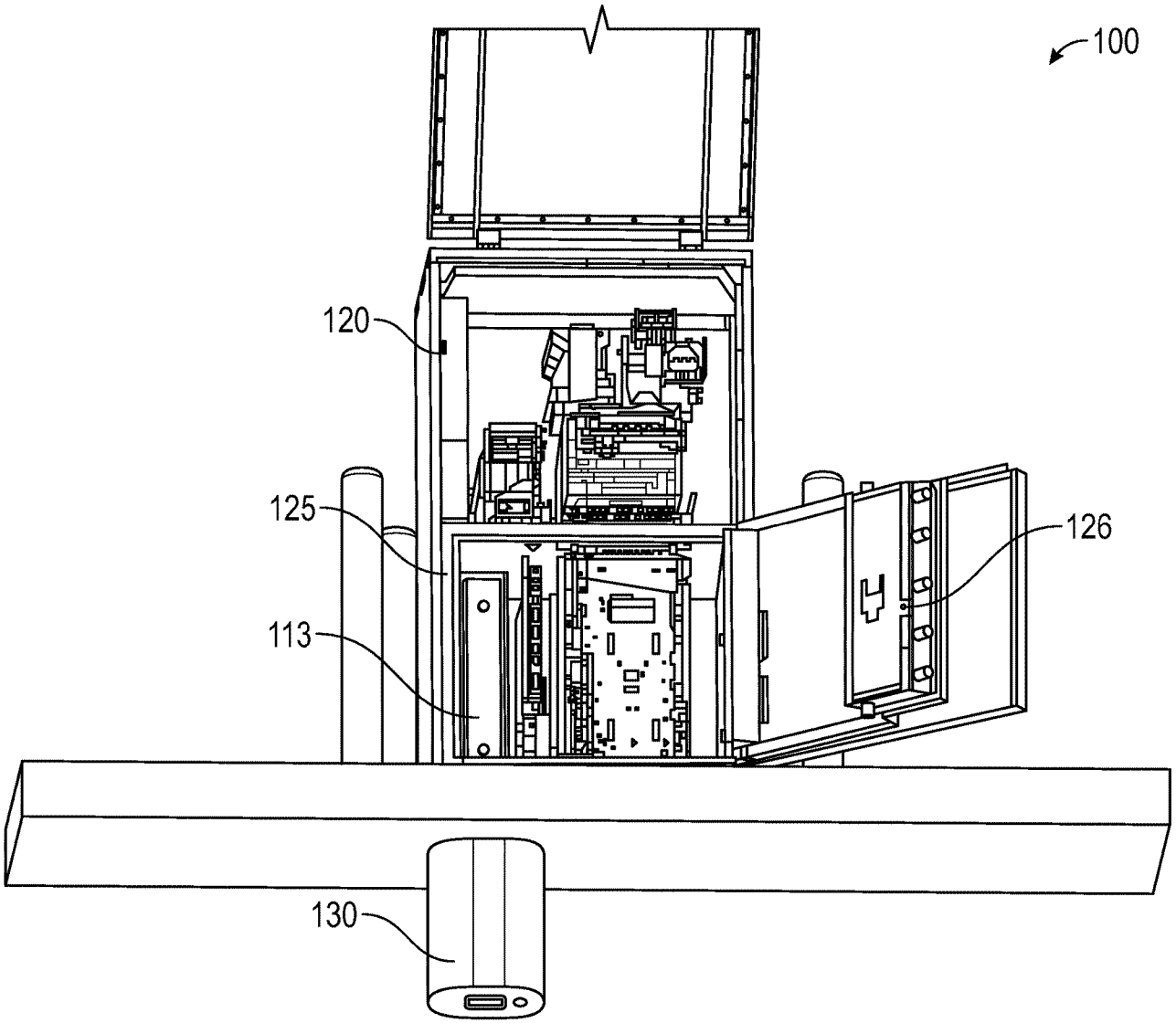
FIG. 5 is a diagram depicting a front view of the secure safe system set in concrete, according to an example embodiment.

FIG. 5 depicts another view of system 100 with front panels of ATM 120 and safe 125 in an opened position. First portion of bollard 113 is surrounded by cured concrete 130 that extends below a bottom surface of island 110 into the ground at the desired site. Second portion of bollard 113 is visible with the safe door 126 opened.

Figure 6:
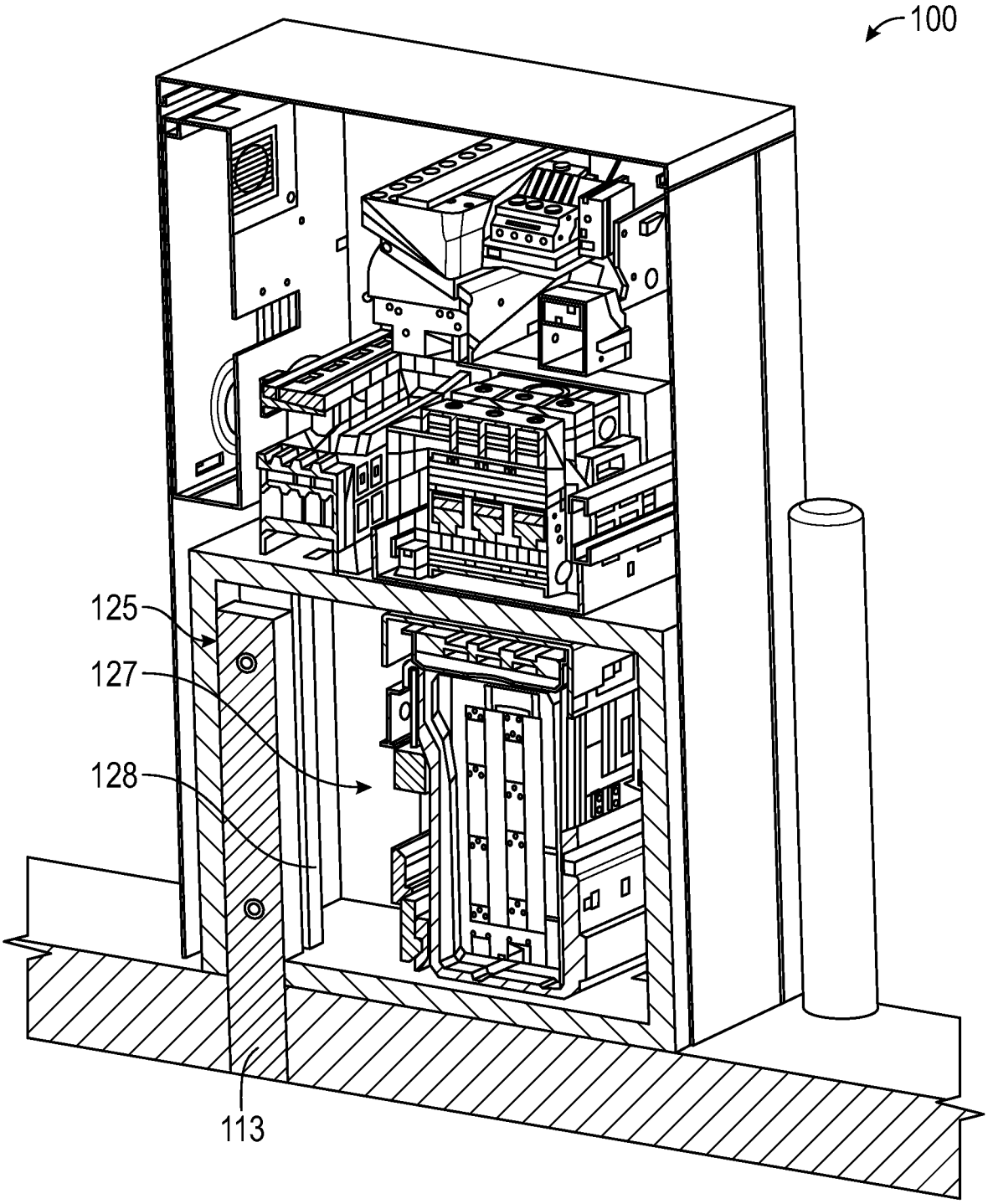
FIG. 6 is a diagram depicting a cross-sectional front view of the secure safe system with an inside view of the safe, according to an example embodiment.

FIG. 6 is a diagram depicting a cross-sectional front view of the secure safe system 100 with an inside view 127 of the safe 125, according to an example embodiment. An inside 127 of safe 125 is visible with the second portion of bollard 113 bolted to a structural beam 128 inside 127 of safe 125.

Figure 7:
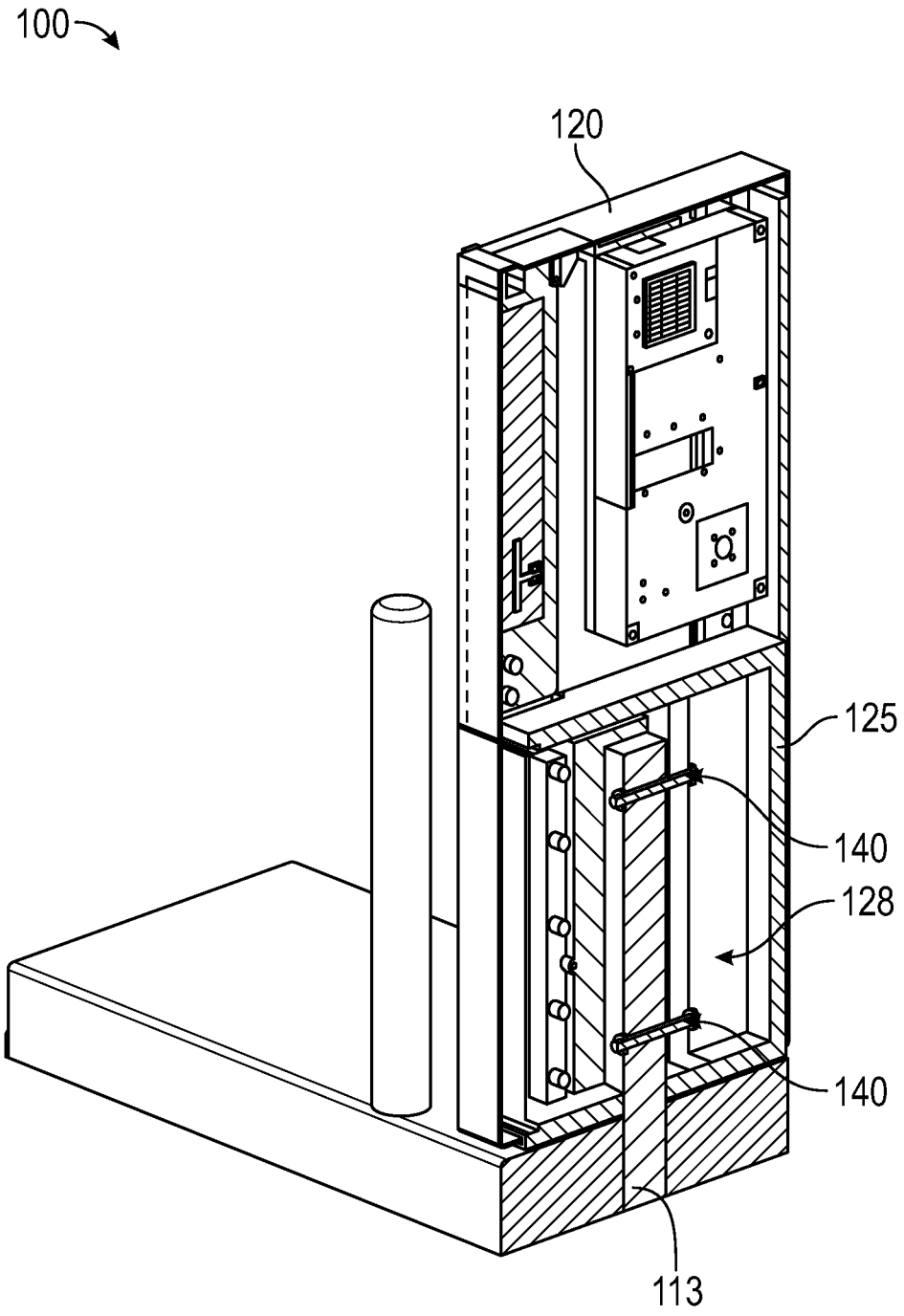
FIG. 7 is a diagram depicting a right-sectional view of the secure safe system with an inside view of the safe, according to an example embodiment.

FIG. 7 is a diagram depicting a right-sectional view of the secure safe system 100 with an inside view of the safe 125, according to an example embodiment.

Second portion of bollard 113 is bolted with two steel bolts 140 into a structural support beam 128 inside of safe 125. Beam 128 is welded and manufactured inside of safe 125 and extends from and through the safe's floor through the safe's ceiling.

Figure 8:
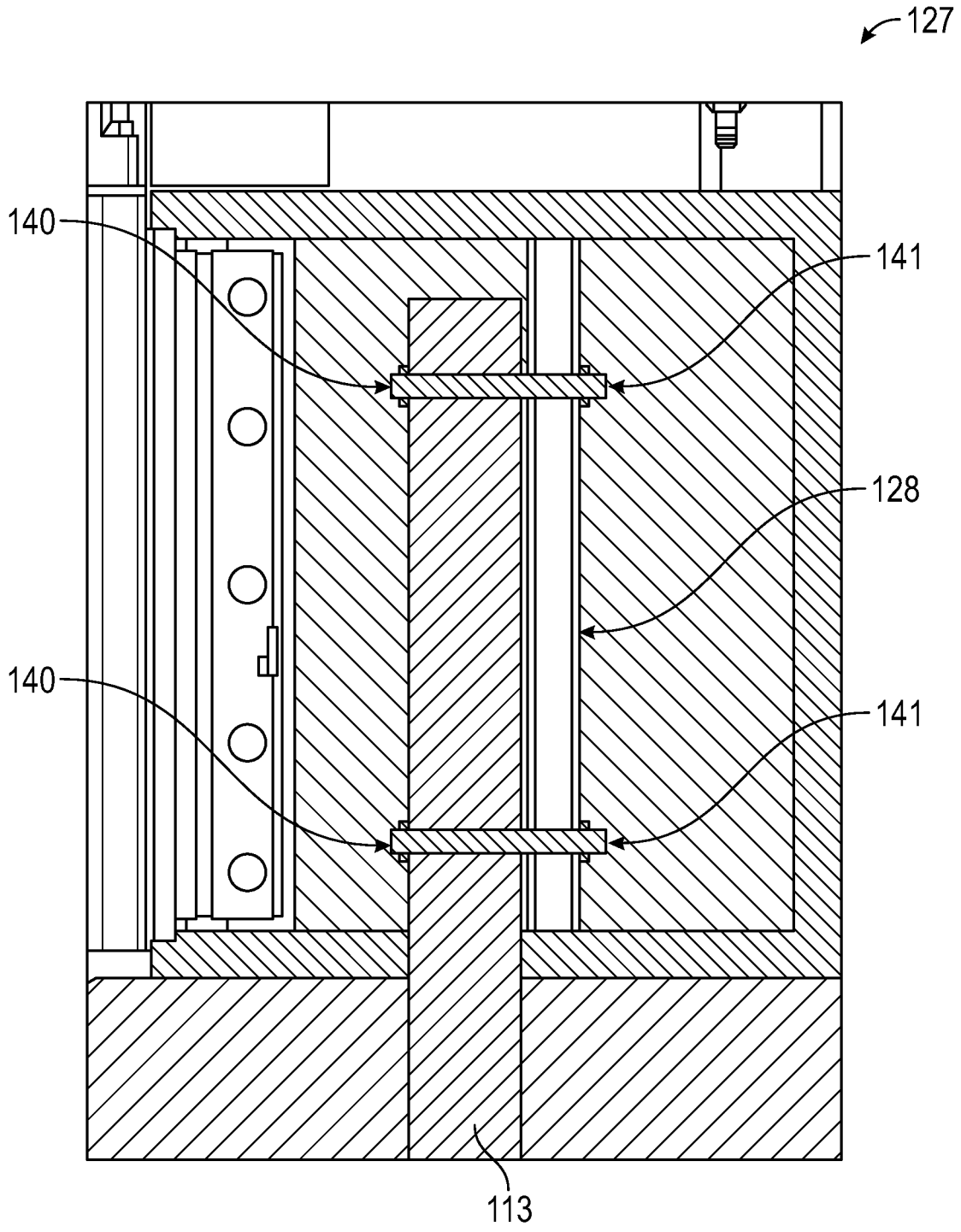
FIG. 8 is a diagram depicting a right-sectional view of the inside of the safe, according to an example embodiment.

FIG. 8 is a diagram depicting a right-sectional view of the inside of the safe 125, according to an example embodiment.

FIG. 8 shows second portion of bollard 113 affixed to beam 128 with two bolts 140 and secured by nuts 141. Bolts 140 are screwed through one side of bollard 113 and extend through bollard 113 and through beam 128 where they are secured by nuts 141.

Figure 9:
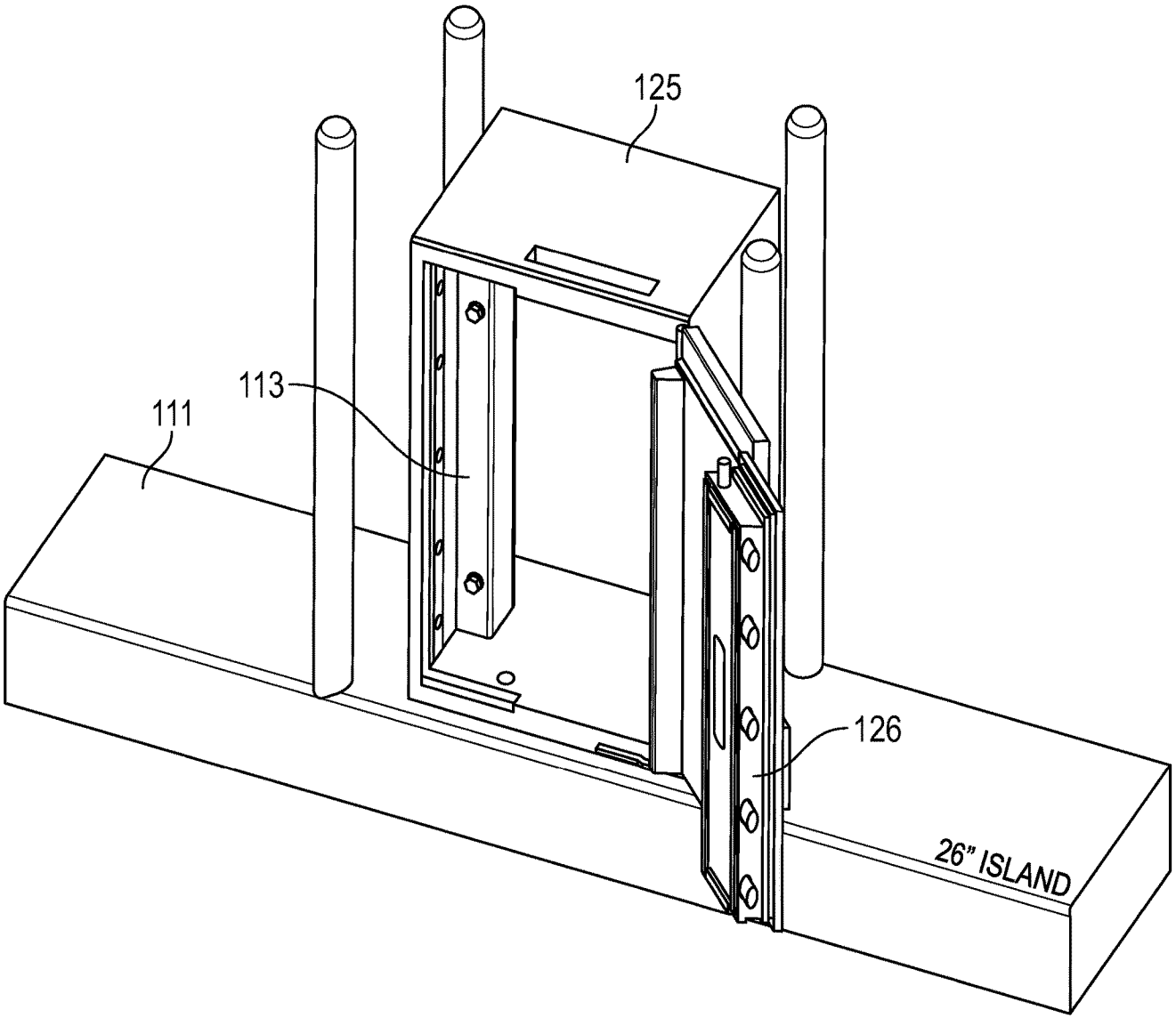
FIG. 9 is a diagram depicting a safe set on the secure safe apparatus with the safe door opened, according to an example embodiment.

FIG. 9 is a diagram depicting a safe 125 set on the secure safe apparatus 110 with the safe door 126 opened, according to an example embodiment.

A front surface of the second portion of bollard 113 is visible in FIG. 9. Bolts 140 are driven into the front surface of bollard 113, through bollard 113, and through beam 128 where the nuts 141 secure the second portion of bollard 113 to beam 128 and safe 125.

Figure 10:
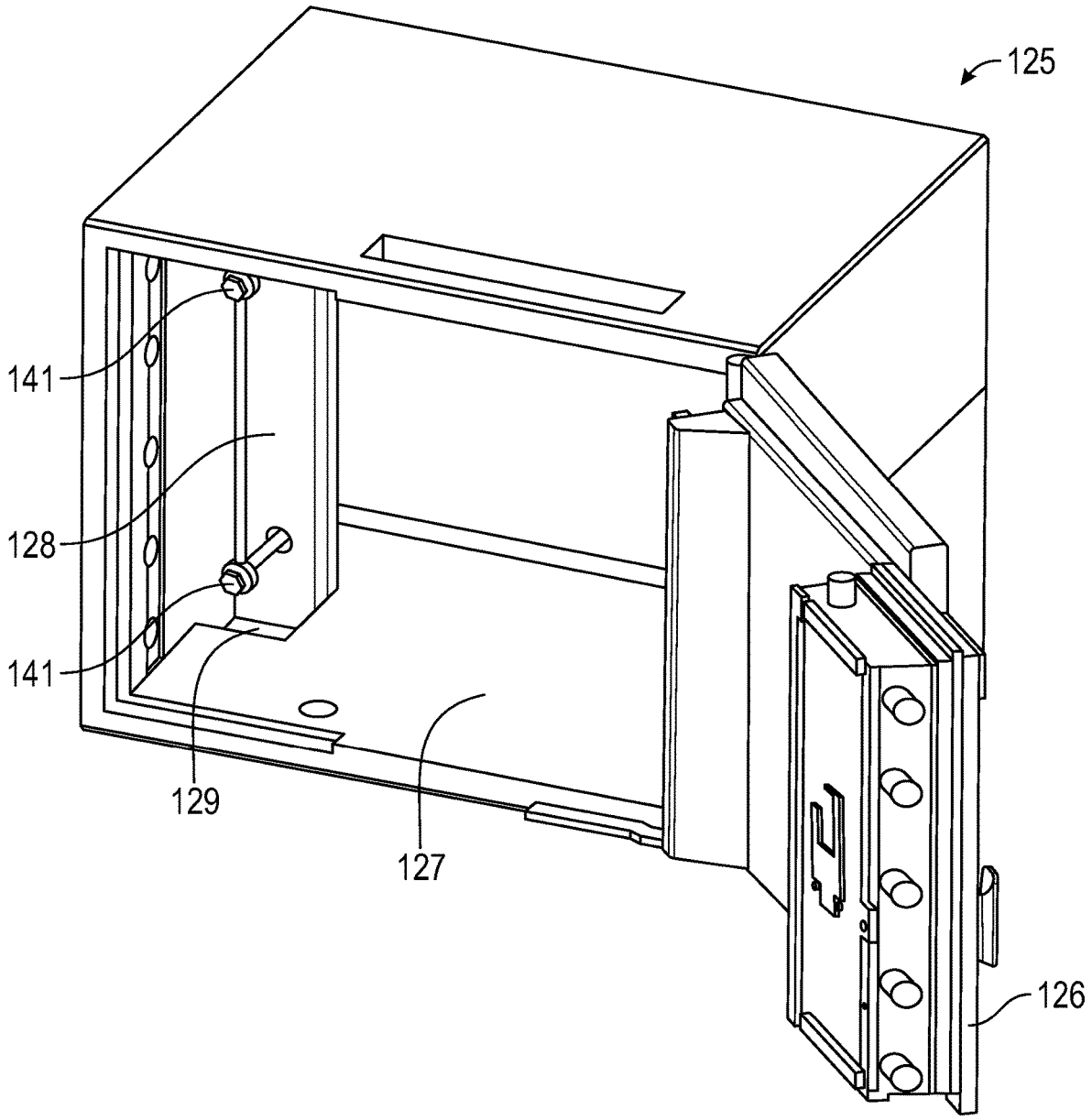
FIG. 10 is a diagram depicting the safe with the safe door opened and unmounted to the secure safe apparatus, according to an example embodiment.

FIG. 10 is a diagram depicting the safe 125 with the safe door 126 opened and unmounted to the secure safe apparatus 110, according to an example embodiment.

An inside 127 of safe 125 is visible from FIG. 10. Beam 128 is shown with bolts 140 but without bollard 113, since the safe 125 is unmounted to secure safe apparatus 110 in FIG. 10. A recess area 129 or an aperture 129 is shown in the safe's floor. Aperture 129 is sufficient enough in area (size and dimensions) to accommodate and receive the second portion of bollard 113 and is oriented such that the entire second portion of bollard 113 is adjacent to and in front of the beam 128 when aperture 129 is set over the second portion of bollard 113 at the desired site to affix bollard 113 to beam 128 using bolts 140 and nuts 141.

Figure 11:
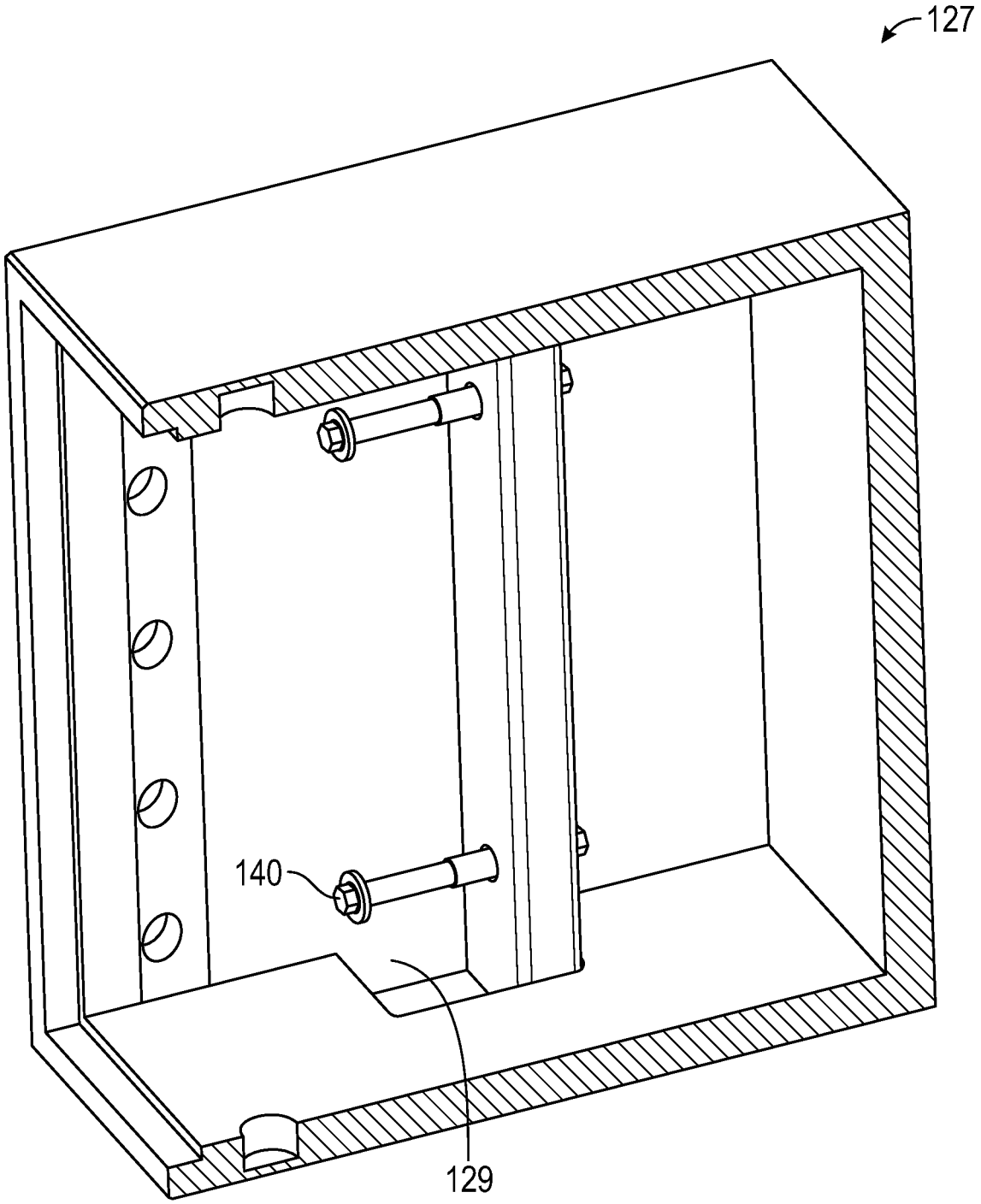
FIG. 11 is a diagram depicting a sectional view of the safe opened and unmounted to the secure safe apparatus, according to an example embodiment.

FIG. 11 is a diagram depicting a sectional view of the safe 125 opened and unmounted to the secure safe apparatus 110, according to an example embodiment.

Aperture 129 is more clearly shown and is adapted to receive the second portion of bollard 113. Bolts 140 are removed before placing the second portion of bollard 113 through aperture 129. Bolts 140 are then assembled through bollard 113, through beam 128, and affixed by nuts 141.

In an embodiment, aperture 129 is manufactured through a side of the safe's housing (body) extending through the floor for a height of the second portion of bollard 113 but not through the safe's ceiling. This permits the safe 125 to be slid into place around the second portion of bollard 113; rather than lifting or hoisting safe 125 over the second portion of bollard 113 at the site.

In an embodiment, bolts 140 are 16 mm in diameter by 175 mm in length (M16×175).

It is noted that no fasteners are visible or protrude from an exterior of the safe's body with system 100. The safe 125 may also still use four security bolts through the floor of the safe 125 into island 110. However, bollard 113 acts to counter any applied force applied to the top of the safe's body, such forces that could help leverage the safe from existing floor security bolts, so that bollard 113 prevents any leveraging that could traditionally be used to free the safe.

Dimensions or a size of bollard 113 may be increased for added security as well as the depth of the first portion of bollard 113 that extends into the ground and is surrounded by cured concrete 130. This will enhance the security of the safe 125. Similarly, dimensions or a size of bollard 113 may be decreased for easier integration and installation of a safe 125 to island 110.

System 100 makes it difficult and impractical for thieves to use non-commercial grade vehicles to separate a safe 125 from its moorings on an island 110. Safes designed for drive-thru ATMs have cash slots on top of their housing making it difficult to access by thieves. As a result, thieves have attempted to remove the safe from the ATMs for transport to other locations where the safes can be blasted or damaged otherwise to open. These types of safes are referred to as "slim safes." Slim safes are also smaller and lighter than safes of indoor ATMs, so they have been prone to rip and carry types of theft. The system 100 provides a mechanism that thwarts these types of theft by making it impractical and unlikely that a non-commercial grade vehicle or other known theft mechanisms can be used as a tool by thieves to rip the safes 125 from system 100.

It is noted that safe 125 may be constructed of heavy-duty steel having a shell that is filled with concrete, concrete and rebar, or concrete and a mesh of materials cured within the concrete. This is done during manufacture of the safe 125 and provides added theft deterrence and blast resistance to the safe's housing. Beam 128 is manufactured with safe 125 in the same manner, such that beam 128 is an integral component of safe 125.

In an embodiment, safe shell or safe body comprises a first fill material that is lighter than a second fill material. The second fill is insert into portions of the shell associated with the top, the bottom, and the beam 128. This provides the necessary hardness and structural support to the beam 128 and the portions of the safe body that are integrally connected to the beam 128, while allowing a overall weight of safe 125 to be reduced because the lighter fill is used with the front, back, and sides of the safe 125. This makes installation and removal of the safe 125 easier by providing a lighter safe 125. Moreover, this does not reduce the security of the safe 125 because the safe 125 still cannot be removed from island 110 with brute force. Authorized individuals that are authorized to install and remove safe 125 are fully aware that an inside 127 of safe 125 comprises beam 128 and are able to open safe door 126 for access to beam 128, once beam 128 is detached from bollard 113, safe 125 is easily removed.

Bollard 113 is hidden on an inside 127 of safe 125, such that thieves are unaware of its presence. As a result, thieves that plan to remove safe 125 from island 110 will not bring the appropriate tools to generate a sufficient force to separate safe 125 from island 110. However, authorized individual will be fully aware of the attachment of bollard 113 to beam 128 and will be able to open safe door 126, detach bollard 113 from beam 128 and easily remove safe 125 from island 113.

Figure 12:
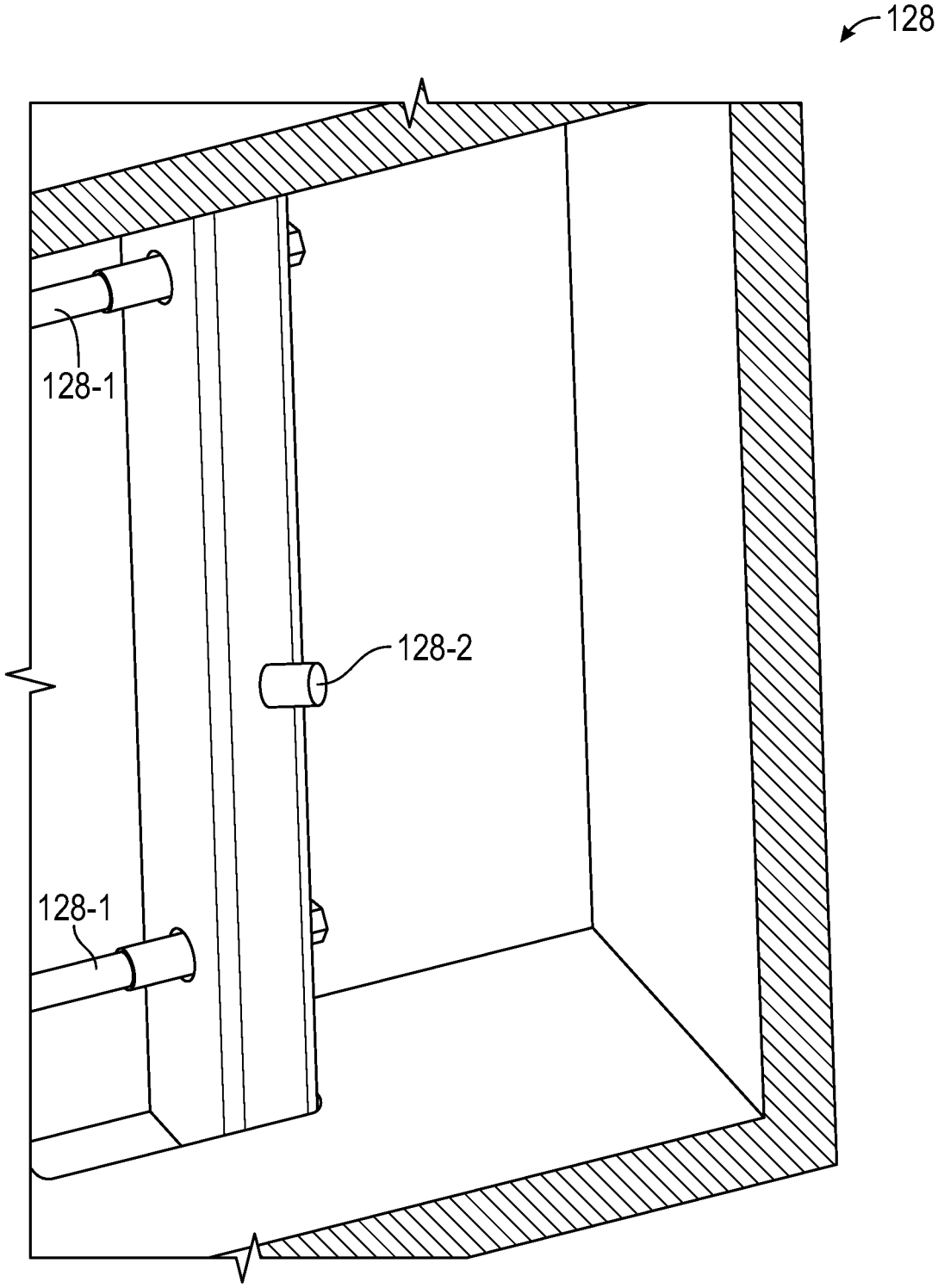
FIG. 12 is a diagram of a fastening mechanism to fasten the safe to the secure safe apparatus during installation, according to an example embodiment.

FIG. 12 is a diagram of a fastening mechanism (128-1 and 128-2) to fasten the safe 125 to the bollard 113 during installation, according to an example embodiment In an embodiment, beam 128 comprises a beam latching or fastening mechanism (128-1 and 128-2) such that bolts 140 and nuts 141 can be dispensed when fastening bollard 113 to beam 128 inside safe 125 during installation at a desired site on island 110. Beam latching or fastening mechanism (128-1 and 128-2) may comprise spring loaded thick steel pins 128-1 that extends out from a front surface of beam 128 and align with prefabricated holes in the second portion of bollard 113. A switch or button can activate the spring and force pins 128-1 to extend out perpendicular to the front surface of beam 128 for insertion into the prefabricated holes of bollard 113. A size of aperture 129 is shorter than a distance that the pins 128-1 extend through bollard 113 making separation of bollard 113 from beam 128 nearly impossible without retracting pins back into beam 128 without using the latching and fastening mechanism (128-1 and 128-2). Additionally, the little remaining space between bollard 113 and an edge of aperture 129 after bollard 113 is inserted into inside 127 of safe 125 is small and comprises concrete wedge 130-1, such that the pins 128-1 do not have to be fastened to bollard 113. The switch may be designed to turn causing the spring to coil and retract the pins 128-1 back into beam 128.

In an embodiment, a shell associated with the safe body is filled with Aircrete® instead of concrete, providing a lighter safe 125.

In an embodiment, a shell associated with the safe body is filled with recycled waste materials used as components to create a concrete mixture providing an environmentally friendly fill, which may also be less expensive than traditional concrete and concrete with rebar mixtures.

In an embodiment, beam 128 does not include or share the shell of the of remaining portions of the safe body. In an embodiment, beam 128 is a Stainless Steel-H beam sized to extend from the floor of the safe 125 to the roof of the safe 125 and/or manufactured so as to be an integral component of a portion of the safe floor and a portion of the safe roof.

The above description is illustrative, and not restrictive. Many other embodiments will be apparent to those of skill in the art upon reviewing the above description. The scope of embodiments should therefore be determined with reference to the appended claims, along with the full scope of equivalents to which such claims are entitled.

In the foregoing description of the embodiments, various features are grouped together in a single embodiment for the purpose of streamlining the disclosure. This method of disclosure is not to be interpreted as reflecting that the claimed embodiments have more features than are expressly recited in each claim. Rather, as the following claims reflect, inventive subject matter lies in less than all features of a single disclosed embodiment. Thus, the following claims are hereby incorporated into the Description of the Embodiments, with each claim standing on its own as a separate exemplary embodiment.

The invention claimed is:

1. A secure safe apparatus, comprising:

a base; and a bollard comprising a first portion and a second portion manufactured as a single vertical member;

wherein the first portion is of a first sufficient length to extend below a bottom surface of the base into ground at a site where the secure safe apparatus is set; and wherein the second portion is of a second sufficient length to extend through a thickness of the base and above a top surface of the base;

wherein the second portion is adapted to be inserted through an aperture in a floor of a safe and affixed to an interior beam manufactured within an inside of the safe.

2. The secure safe apparatus of claim 1, wherein the base comprises a hole through the base at a location on the base that aligns with the bollard.

3. The secure safe apparatus of claim 2, wherein the first portion is adapted to be inserted through the hole of the base with the first portion extending a first distance into the ground and affixed to the ground and to the base with concrete or a combination of concrete and rebar.

4. The secure safe apparatus of claim 3, wherein the secure safe apparatus comprises a column of concrete or a combination of concrete and rebar poured into and cured within the ground for the first distance, the hole in the base, and a thickness of a floor of the safe defining the aperture.

5. The secure safe apparatus of claim 4, wherein the column of concrete or the combination further comprises a formed wedge of concrete or the the formed wedge of the combination of concrete and rebar that extends from a front-facing and bottom side of the second portion that is adjacent to the aperture in the floor of the safe towards a front of the safe.

6. The secure safe apparatus of claim 5, wherein concrete or the combination concrete and rebar of the formed wedge is cured as a top extension of and an integral part of the column of concrete to form a single concrete member that affixes the bollard to the base, the ground, and the floor of the safe.

7. The secure safe apparatus of claim 1, wherein the bollard is a vertical-squared member manufactured as a combination of concrete and rebar.

8. The secure safe apparatus of claim 7, wherein a thickness of the vertical-squared member is approximately 100 $mm^2$.

9. The secure safe apparatus of claim 8, wherein a length of the vertical-squared member is equal to or greater than approximately 730 mm.

10. The secure safe apparatus of claim 1 further comprising, four vehicle deterrent posts that surround the safe when the safe is affixed to the secure safe apparatus, wherein the bollard is offset within the base closer to a first set of two of the four vehicle deterrent posts relative to a second set of two of the four vehicle deterrent posts.

11. A secure safe, comprising:

a safe body:

a safe door;

a beam manufactured within an inside of the secure safe and integrated into a top of the safe body and a floor of the safe body; and an aperture manufactured in the floor of the safe body;

wherein the aperture is adjacent to and in front of the beam;

wherein the aperture defined with dimensions in the floor of the safe body sufficiently to receive a bollard of the secure safe.

12. The secure safe of claim 11, wherein the beam comprises screw receptacles adapted to receive at least two bolts screwed through the bollard, through the receptacles of the beam, and fastened by at least two or more nuts.

13. The secure safe of claim 12, wherein each of the screw receptacles are sized to fit each of the at least two bolts, and wherein each of the at least two or more bolts is manufactured as steel comprising a diameter of 16 mm and a length of 175 mm.

14. The secure safe of claim 11, wherein the beam comprises spring loaded pins and a switch that when activated cause pins to extend from a front surface of the beam and insert into aligned holes in the bollard of the secure safe.

15. The secure safe of claim 11, wherein the beam is manufactured to align with and adjacent to the bollard when the secure safe is placed over the bollard and onto a horizontal surface of the secure safe.

16. The secure safe of claim 11, wherein the safe body comprises a steel shell adapted to be filled with concrete, concrete with rebar, or concrete with a mesh material.

17. The secure safe of claim 16, wherein the beam is part of the safe body and part of the shell.

18. The secure safe of claim 11, wherein the floor of the safe comprises the aperture and at least four receptacles adapted to receive bolts to further secure the floor of the secure safe to a horizontal surface of the secure safe when the secure safe is placed over the bollard and onto the horizontal surface of the secure safe.

19. A secure safe system, comprising:

an island comprising a first aperture;

a bollard sized to fit through the first aperture of the island and a secure aperture of a secure safe; and the secure safe comprising:

a safe body;

the second aperture in a floor of the safe and adjacent to and in front of a beam; and the beam that vertically extends from and through the floor of the safe body and to and through a top of the safe body within an inside of the safe body;

wherein the island is adapted to provide a top surface upon which the secure safe is affixed at a site;

wherein the bollard comprises a single manufactured vertical member having a first portion that fits through the first aperture and extends below a bottom surface of island into the ground and a second portion that extends above the top surface of the island through the second aperture and aligned with the beam located within the inside of the safe body;

wherein the bollard is affixed to the beam on the inside of the safe body when the secure safe is set on the top surface at the site.

20. The system of claim 19, wherein the island further comprises four vehicle deterrent posts that vertically extend above the top surface of the island and that surround the secure safe when the secure safe is set over the bollard and rests on the top surface of the island;

wherein the beam comprises at least two bolt receptacles adapted to receive bolts driven through the second portion of the bollard, through the at least two bolt receptacles of the beam, and fastened with at least two nuts when the secure safe is affixed to the island; and wherein the floor of the safe comprises at least four additional bolt receptacles adapted to receive additional bolts driven through the floor and into the top surface of the island when the secure safe is affixed to the island.

* * * * *